US007971520B2

(12) United States Patent
Nölle

(10) Patent No.: US 7,971,520 B2
(45) Date of Patent: Jul. 5, 2011

(54) FLUID POWER ARRANGEMENT

(75) Inventor: Gerhard Nölle, Plochingen (DE)

(73) Assignee: Festo AG & Co. KG, Esslingen (DE)

( * ) Notice: Subject to any disclaimer, the term of this patent is extended or adjusted under 35 U.S.C. 154(b) by 606 days.

(21) Appl. No.: 12/074,681

(22) Filed: Mar. 5, 2008

(65) Prior Publication Data

US 2008/0236686 A1 Oct. 2, 2008

(30) Foreign Application Priority Data

Mar. 31, 2007 (DE) ..... 10 2007 015 656

(51) Int. Cl.
*F15B 13/08* (2006.01)

(52) U.S. Cl. ..... 91/432; 92/163; 285/93

(58) Field of Classification Search ..... 60/420; 91/432; 285/25, 93; 92/163
See application file for complete search history.

(56) References Cited

U.S. PATENT DOCUMENTS

| | | | | |
|---|---|---|---|---|
| 3,170,667 | A * | 2/1965 | Szohatzky | 285/914 |
| 3,865,013 | A * | 2/1975 | Mastaj | 91/432 |
| 3,873,062 | A | 3/1975 | Johnson et al. | |
| 4,165,613 | A * | 8/1979 | Bernhoft et al. | 60/420 |
| 2003/0102030 | A1 | 6/2003 | Reichert et al. | |
| 2004/0011396 | A1 | 1/2004 | Zwirner | |
| 2005/0173852 | A1 | 8/2005 | Zimpfer et al. | |

FOREIGN PATENT DOCUMENTS

| | | |
|---|---|---|
| DE | 25 02 830 | 1/1975 |
| DE | 296 16 034 | 9/1996 |
| DE | 100 40 559 | 8/2000 |
| DE | 101 16 566 | 4/2001 |
| DE | 102 21 277 | 5/2002 |

* cited by examiner

*Primary Examiner* — F. Daniel Lopez
(74) *Attorney, Agent, or Firm* — Hoffman & Baron, LLP

(57) ABSTRACT

A fluid power arrangement includes a valve means and a fluid power implement, which is connected or is able to be connected with the valve means by way of a first fluid line a and at least one second fluid line for fluid actuation through the valve means (13*a* and 13*b*), the valve means and the implement constituting spatially separate assembly units, the valve means having a first valve fluid port for the first fluid line and at least one second valve fluid port for the at least one second fluid line and the implement having a first implement fluid port for the first fluid line and at least one second implement fluid port for the at least one second fluid line. In the fluid power arrangement there is a provision such that the first valve fluid port and the first implement fluid port on the one hand and on the at least one second valve fluid port and the at least one second implement fluid port on the other hand mutually different port encodings are provided so that a coordination of the first valve fluid port with the first implement fluid port and of the at least one second valve fluid port with the at least one second implement fluid port is apparent on the basis of the respective mutually corresponding port encodings.

20 Claims, 3 Drawing Sheets

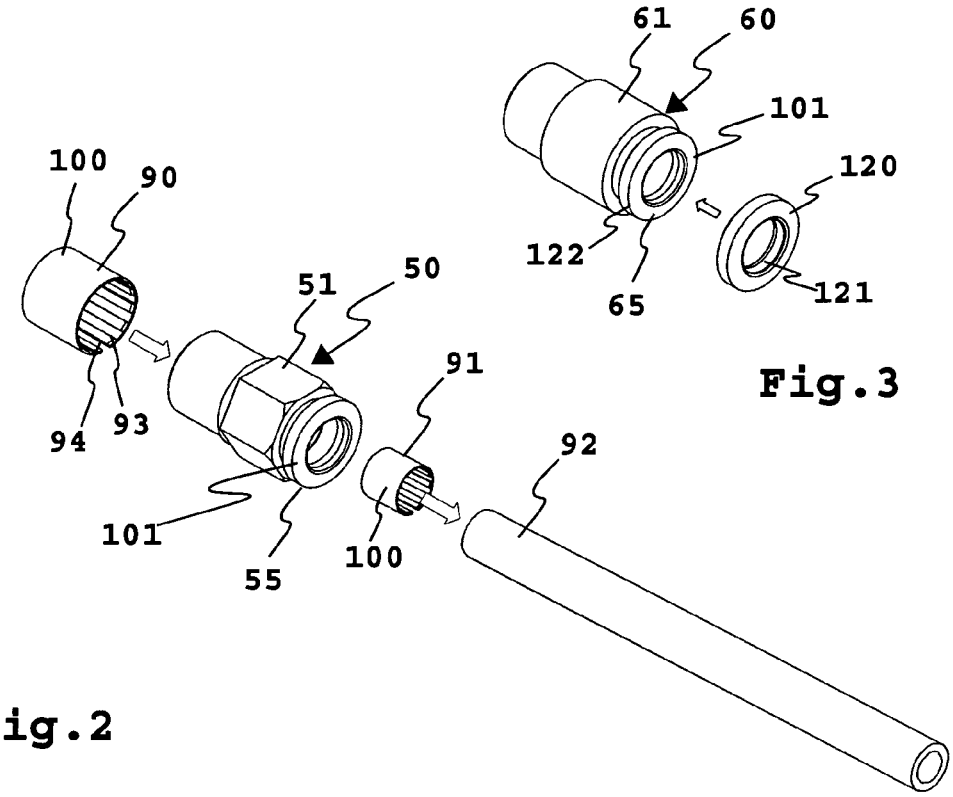
Fig.2
Fig.3
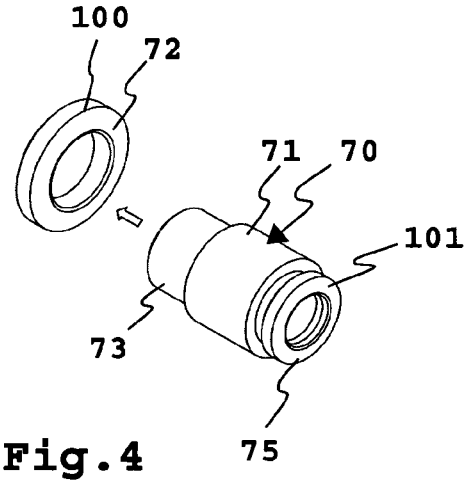
Fig.4
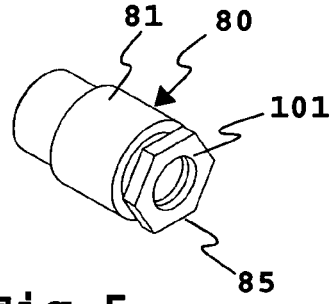
Fig.5

FLUID POWER ARRANGEMENT

BACKGROUND OF THE INVENTION

The invention relates to a fluid power arrangement comprising a valve means and a fluid power implement, which is connected or is able to be connected with the valve means by way of a first fluid line and at least one second fluid line for fluid actuation through the valve means, the valve means and the implement constituting spatially separate assembly units, the valve means having a first valve fluid port for the first fluid line and at least one second valve fluid port for the at least one second fluid line and the implement having a first implement fluid port for the first fluid line and at least one second implement fluid port for the at least one second fluid line.

The implement may for example be a pneumatic cylinder, which is pneumatically controlled using the valve means, as for example a servo valve. Prior to putting the two assembly units into operation they must be joined together by way of fluid line, as a rule flexible hose. Here errors may occur so that for example the first valve fluid port is misjoined to the second implement fluid port and the second valve fluid port is misjoined with the first implement fluid port. Accordingly as a rule a functional test is performed, that is to say, the arrangement is subjected to a low working pressure so that any possible erroneous hose placement cannot lead to damage to the fluid power arrangement owing to slow speeds and low force levels.

Such a test is however time consuming and for many applications it is not practicable. For instance regulated pneumatic implements such as positioning drives, are only put into operation after the overall installation of plant or machinery, as f. i. a machine tool. Then operations are already performed with the normal working pressure, because a regulating means provided for the implement and as a rule controlling the valve means restricts, during regular operation of the plant or machine, speeds, pressures and forces so that damage is precluded. Setting the working pressure to a lower level for testing is frequently impossible, since there are no suitable chokes in the case of regulated implements.

For putting into operation and in particular for a test as to whether hose placement is correct, suitable software may be employed to perform a test run. However there is not always such software available, or the possible user does not employ it owing to ignorance or lack of time.

If now there is an incorrect hose placement or, respectively, an incorrect fluid connection between the valve means and the implement, this may in the worst case entail damage to the fluid power arrangement and/or the plant or machine, which is driven by the fluid power arrangement. There will namely be a parasitic coupling or amplification effect, because the regulator is actually attempting to employ the action of opposite pressure to avoid an actuator member of the implement, as for example its piston, being moved oppositely to the desired or set target direction of motion. Owing to the wrong fluid port between the valve means and the implement this however will entail the opposite effect, that is to say the actuator member subjected to fluid, as for example compressed air, acting oppositely to the desired direction of shifting.

In the case of regulated drives the valve means are furthermore as a rule switching valves. In the case of the implement being in the vicinity of the terminal positions, there are no limit shock absorbers since this function is performed by the regulating means. When the valve means and the implement are incorrectly joined up, an actuator member for example will impact at full charge against the terminal abutment.

Wrong hose placement on the valve means and the implement therefore entails improper functioning, damage and in any case to a delay in putting the system into operation, even if the damage may be avoided by testing.

SHORT SUMMARY OF THE INVENTION

Accordingly it is one object of the present invention to provide a readily assembled fluid power arrangement whose hose placement may be implemented in a simple manner for correct functioning.

In order to attain this object there is a provision in a fluid power arrangement of the type initially mentioned such that on the first valve fluid port and the first implement fluid port on the one hand and on the at least one second valve fluid port and the at least one second implement fluid port on the other hand mutually different port encodings are provided so that a coordination of the first valve fluid port with the first implement fluid port and of the at least one second valve fluid port and the at least one second implement fluid port is apparent on the basis of the respective mutually corresponding port encodings.

The port encodings make it clear which valve fluid port belongs to which implement fluid port. Accordingly fitting of the fluid lines is simplified. The user or respectively the assembly fitter will be readily able to find the mutually corresponding fluid ports. Furthermore for an examination of the fluid power arrangement the port encodings are expedient: it is possible to recognize a correct hose placement on the basis of the port encodings.

When the first valve and implement fluid ports are for example colored and/or mechanically characterized, f. i. by color markings, a color marking which is not present on the second valve and implement fluid ports, will constitute f. i. a second port encoding.

Admittedly it would in principle be possible for only the fluid ports to be encoded. If for instance a fluid line inserted into the first implement fluid port is grasped by the user and then the free end of the fluid line is introduced into the correspondingly encoded first valve fluid port, a correct connection is possible. It is however particularly expedient if fluid line encodings are presence on the first or at least one second fluid line and at least at their port or terminal portion, which are associated with the implement fluid ports or the valve fluid ports. The first and the at least one second fluid line are for example prefabricated and are provided with a fluid line encodings. The fluid line are f. i. flexible hose.

Port encodings and fluid duct encodings coordinated with or matching each other are preferably identical. Thus for example in the case of mutually associated port encodings the same color encodings will be provided, for example red ones. Furthermore the mutually associated fluid duct encodings, for example at the end portions, preferably will have the same color or shade of color. It will be clear in this context that the word "identical" is to be understood to mean that not the same color shade but just the same color is meant, if it is a question of color encodings. Thus for example a lighter and a darker color shade may represent the same encoding. Different shades of color are for example produced by having different materials for the fluid lines and the fluid ports.

In fact color encodings for the port encodings and/or the fluid line encodings are advantageous. In this respect it is more particularly advantageous if a fluid line, which connects associated fluid ports with each other, and the fluid ports connected by the fluid line have one and the same color encoding.

In conjunction with pneumatic systems it is already known as such to employ colored fluid lines and more particularly hose. This coloration however is employed to denote the particular medium flowing in the hose, or the particular application of the fluid line. Thus for example in vacuum technology yellow hose may be utilized. In antistatic arrangements black hose or fluid line is usual, whereas in food technology white hose is conventional. In the case of the hose employed in a well known fluid power arrangement however fluid lines or hose are utilized all having the same color, that is to say erroneous hose placement, as initially explained, cannot be avoided in this manner.

In this respect the invention is based on a different approach: the fluid ports have different functionalities. Thus for example the first fluid ports of the valve means and of the implement are provided for a forward movement of the implement, whereas the second fluid ports of the valve means and of the implement are provided for a backward movement of the implement. The fluid ports for a respective direction of movement have the same port encoding, for example the same color encoding. It is then also expedient for the associated fluid lines to possess the same color encoding, at least at their respective terminal portions.

An adaptable coloration scheme is such that the color encoding is constituted by a color marking portion, as for example a ring, which is mounted on the respective fluid port or fluid line. Accordingly identically colored, for example metallic fluid ports, may be employed, which however are marked by coloration by the color marking portion. Furthermore it is unnecessary to have fluid lines whose material is colored right through, as for example fluid line hose. In fact it is sufficient for example to mark the respective terminal portions of the fluid lines in color, something which avoids incorrect functioning. The fluid line may generally still be f. i. yellow for vacuum applications and in the case of antistatic applications black and in food technology white. It is merely the port or terminal portions which in accordance with the invention have a colored encoding.

The color marking portion may be able to be permanently or detachably connected with the respective fluid line. Thus colored clips for example, which are clipped onto the fluid line or on the fluid port, have turned out to be advantageous.

Furthermore mechanical or physical marking is an advantage for the port encodings and/or fluid line encodings. Such mechanical markings are preferably haptically distinct so that they can be felt by the operator. Thus in poorly lit or dark surroundings, where the operator is unable to see properly they may be felt by him to detect whether the fluid line is stuck into the correct fluid port.

The encoding may for example be constituted by surface treatment, e. g. striations, the geometry of the outline or the like. For instance distinct outlines may be employed for the fluid ports in order to recognize them mechanically. In this respect for instance round, angular, polygonal or the like outlines are possible. Furthermore different diameters of the fluid ports or fluid lines may be with advantage utilized as mechanical markings. The diameters may for example be the outer diameters. In order to ensure an equal pressure level it is however an advantage if at least the flow cross sections of the fluid ports and of the fluid lines are substantially equal. Different outer diameters of the fluid line, which at least in the port portions of the fluid port are the same port as regards the port part, advantageously avoid the "wrong" fluid line being plugged into a fluid port.

It is an advantage if at least one port encoding is provided on a release actuating portion of a fluid port, for example on a release ring. The release actuating portion is for example shifted by a thrust movement into the released position so that the fluid line may be unplugged. The release actuating portion is for example encoded in color and/or mechanically.

It is however possible for the port encoding to be provided on a housing portion, which contains the respective fluid port, for example adjacent to the respective fluid port. The port encoding may for example be a colored ring or a colored marking, which is arranged adjacent to the fluid port. For instance the port encoding can be constituted by a ring portion, which is fixed in position on screwing a fluid port body to the housing of a valve means or of the implement.

The port encoding is best provided adjacent to or on a mounting portion, as for example a screw portion, of a fluid port body, which is able to be mounted or is mounted on the valve means or the implement.

The valve means is preferably a pneumatic valve means and for the fluid power implement is preferably a pneumatic or electropneumatic drive. For instance the implement may be a pneumatic cylinder with or without a piston rod.

The valve means may be a component of a valve cluster in the case of which several valves are lined up adjacent to one another in a row direction. Preferably the valve means is however a separate valve means able to be freely installed, as for example a servo valve.

A port encoding or a fluid line encoding can also be constituted by a graphic encoding, as for example a pattern of lines, of dots or the like.

It is naturally possible to utilize a plurality of types of encoding. Thus for instance a mechanical encoding may be emphasized additionally by coloration or a pattern of grooves may be such that it also appears as graphic encoding.

The fluid power arrangement in accordance with the invention is best a positioning subassembly, which during manufacture is completely prefabricated, i. e. the fluid lines or hoses and the implement are already provided with the corresponding encodings by the manufacturer.

In the following working examples of the valve will be explained with reference to the drawings.

LIST OF THE SEVERAL VIEWS OF THE FIGURES

FIG. 2 shows a fluid port element with a polygonal outline and a clippable color marking portion for marking it by coloration.

FIG. 3 shows a fluid port element with a round outline and a round release ring.

FIG. 4 shows the fluid port element in accordance with FIG. 3 in conjunction with a color marking ring.

FIG. 5 shows a fluid port element with a polygonal release ring.

DETAILED ACCOUNT OF WORKING EMBODIMENTS OF THE INVENTION

Figure 1:
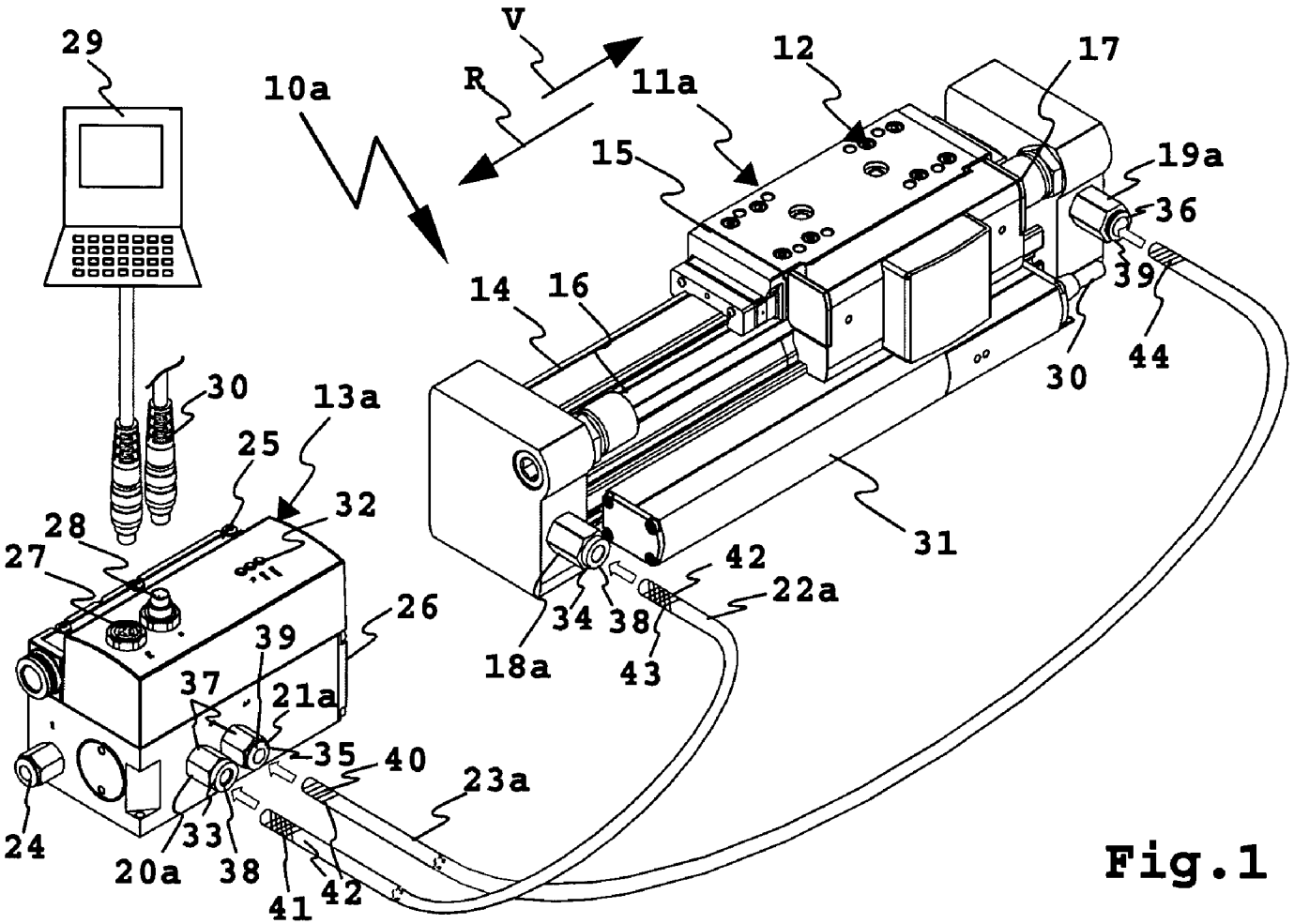
FIG. 1 shows a fluid power arrangement comprising a linear drive and a pneumatic valve means for control thereof and furthermore hoses for connection of the valve means and of the drive.
Figure 6:
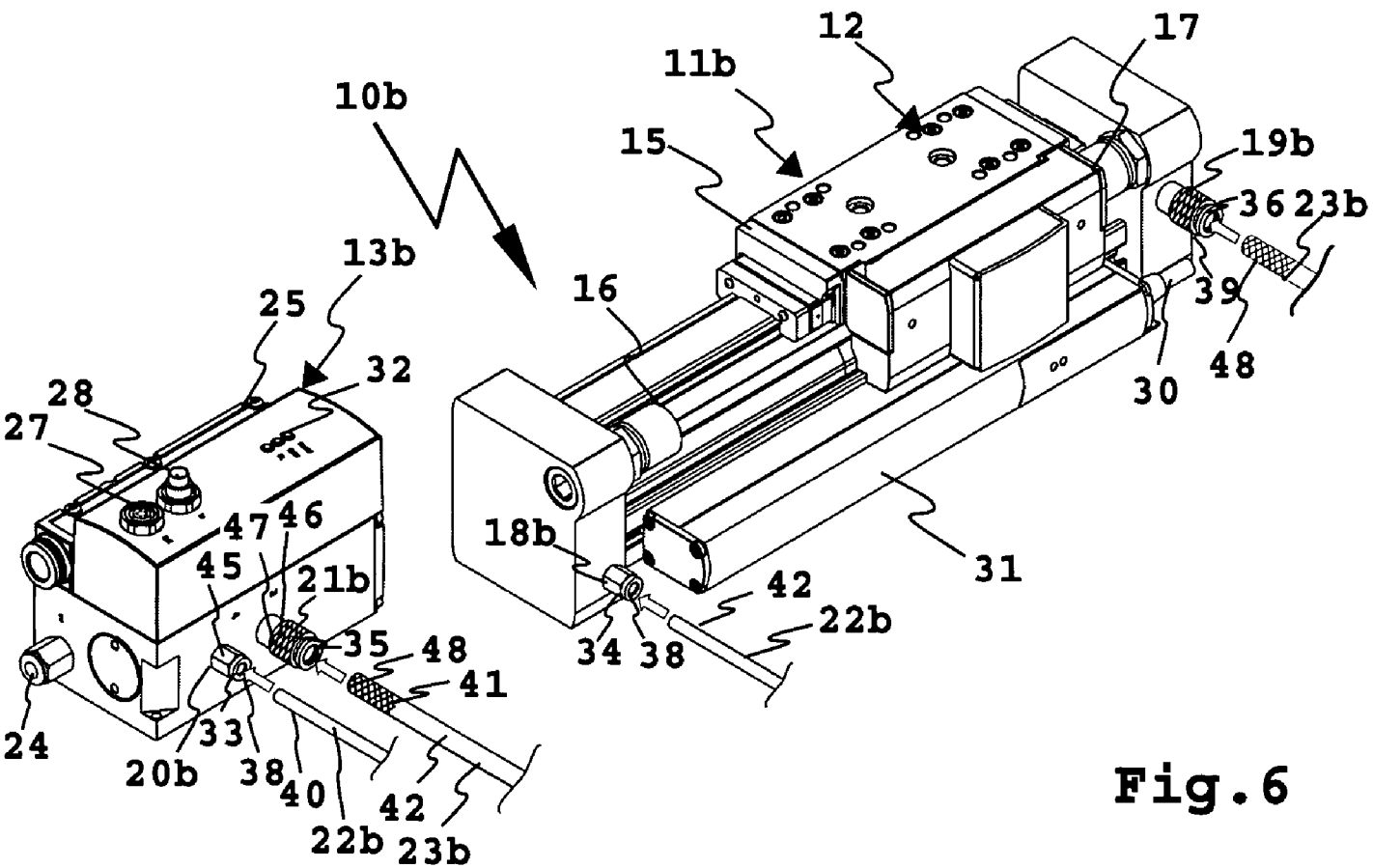
FIG. 6 shows a second fluid power arrangement similar to that of FIG. 1 but with alternative fluid port elements.

The working embodiments of the invention in part have components which are identical or have equivalent functions, same being provided with the same reference numerals and not being described twice over.

A fluid power arrangement 10*a* comprises a pneumatic drive 11*a* as a fluid power implement 12. The drive 11*a* is a linear drive. The drive 11*a* is supplied by way of a valve means 13*a* with fluid, in the present case compressed air, so that an actuator member (not illustrated) in the interior of the drive 11*a* may shift a carriage 15, carried on the outside of the housing 14 of the drive 11*a* between terminal abutments 16 to and fro.

For forward motion V of the carriage 15 toward the terminal abutment 17 the valve means 13*a* supplies fluid to the drive 11*a* at an implement fluid port 18*a*, while compressed air may vent from an implement fluid port 19*a* (which is arranged on the drive output side) near the terminal abutment 17.

In an opposite direction, that is to say in the case of backward travel R, the valve means 13*a* feeds compressed air to the implement fluid port 19*a*, while at the same time compressed air may exit from the implement fluid port 18*a* on the outflow side.

The implement fluid ports 18*a* and 19*a* are able to be joined with valve fluid ports 20*a* and 21*a* of the valve means 13*a* by way of fluid lines 22*a* and 23*a* and are connected for operation of the arrangement 10*a*. The fluid lines 22*a* and 23*a* are flexible hose, which is able to be plugged into the fluid ports 18*a* through 21*a* and is then automatically locked by same.

The valve means 13*a* is able to be supplied by way of a supply port 24 with compressed air. Returning compressed air from the implement 12 into the valve means 13*a* can then flow out by way of a venting means 25, as for example a muffler. The spent air means 25 constitutes a component of the valve means 13*a* and is arranged on the housing 26 thereof.

Furthermore electrical terminals 27 and 28 are arranged on the housing 26 for the connection of the valve means 13*a* with control and sensor instrumentalities. For instance, the port 27 may be a bus port for connection of a control means 29 controlling or regulating the valve means 13*a*. Into the port 28 a connection line 30 may be plugged for connection of the valve means 13*a* with a position sensor means 31. The position sensor means 13 detects the respective position of the carriage 15. Furthermore there are display means 32 for the display of operational states such as error states, correct electrical power levels or the like, on the valve means 13*a*.

Owing to the design of the ports 27 and 28 as sockets and plugs an electrically correct wiring of the arrangement 10 may readily be ensured. However as ell as regards fluid power or pneumatic features hose placement or fluid connection between the implements 11*a* and 13*a* may readily be produced in accordance with the invention. For this purpose the encodings described below in detail are an advantage at the fluid ports and fluid lines.

The implement fluid port 18*a* and the valve fluid port 20*a* have a first mechanical encoding 33 in the form of identical release rings 34. The release rings 36 of the fluid ports 19*a* and 21*a* are mechanically distinct from the release rings 34 and accordingly constitute a second mechanical encoding 35. For instance the release rings 34 project farther in front of the fluid port bodies 37 of the fluid ports 18*a* and 20*a* than the release rings 36 in the case of the similar fluid port bodies 37 of the fluid ports 19*a* and 21*a*.

The encodings 33 and 35 constitute first and second port encodings 38 and 39 which are different to each other.

Furthermore the fluid lines 22*a* and 23*a* have first and second fluid duct encodings 40 and 41. The fluid duct encodings 40 and 41 are provided on the respective end fluid lines 22*a* and 23*a*. The fluid duct encodings 40 and 41 are for example constituted by colored encodings 43 and 44. In the example the end portions 42 of the fluid line 22*a* for forward travel V are colored blue, whereas end portions 42 of the fluid line 23*a* for return travel R are colored black. It will be clear that the fluid lines 22*a* and 23*a* may be colored right through, may have a colored pattern or the like so that they are marked in color and are encoded.

Furthermore it is an advantage for the fluid ports 18*a* and 20*a* and the also fluid ports 19*a* and 21*a* to have the color encoding 44 so that there is a clear association by color between a fluid line and a fluid port.

A fluid power arrangement 10*b* has in part similar components to those of the arrangement 10*a*. The arrangement 10*b* comprises a drive 11*b*, which is controlled by a valve means 13*b*. For a satisfactory and correct pneumatic connection in the arrangement 10*b* essentially mechanical encoding is employed. Valve fluid ports 20*b* and 21*b* are mechanically identical and accordingly are mechanically encoded like the implement fluid ports 18*b* and 19*b*. The fluid ports 18*b* and 20*b* are constituted by fluid port parts 45, whereas the fluid ports 19*b* and 21*b* are formed by fluid port parts 46.

The fluid port parts 45 and 46 are mechanically distinct in design. For instance, the fluid port parts 45 possess a hexagonal or other polygonal outline, whereas the fluid port parts have a round outline. Furthermore the fluid port parts 46 have a striation 47 so that they may be readily distinguished by feel, i. e. haptically, from the fluid port parts 45.

A striation 48, which is provided at the end portions 42 of a fluid line 23*b* connecting the fluid ports 19*b* and 21*b* has the same pattern or, respectively, the same geometry as the striation 47. Accordingly coordination of the fluid line 22*b* by feel or haptically with the fluid ports 19*b* and 21*b* is quite readily possible. One fluid line 22*b*, which is provided for connection of the fluid ports 18*b* and 20*b*, namely has no striation, something which again represents a fluid duct encoding 40, which again is distinguished by the fluid duct encoding 41 constituted by the striation 48.

An additional way of ensuring proper coordination is that the fluid lines 22*b* and 23*b* have different outer diameters at their end portions 42, such diameters corresponding to the corresponding inner diameters of the connection ports 45 and 46.

On the basis of fluid port parts 50, 60, 70 and 80 further possibilities of encoding will be described in the following.

To take an example one fluid port body 51 of the fluid port part 50 has a hexagonal outline, whereas the fluid line port parts 60, 70 and 80 have fluid port bodies 61, 71 and 81 with a round outline. The fluid port bodies 61 and 71 could for example be characterized by colored markings to show that they are different. As colored markings rings are however also suitable, in the form of for example of a colored ring 72 in red, blue, green or the like. An assembly portion 73, which for example is provided on the outer side with screw threads, is inserted through the colored ring 72 and screwed into the respective housing 14 or 26. The ring 72 is then for example clamped between the housing 14 or 26 on one side and held against a projection 74 in the fluid port body 71.

Spring rings 90 and 91 as well are suitable marking insignia, which for example consist of colored plastic material. The spring ring 90 is designed for clipping onto a respective fluid port part 50, 60, 70 or 80, for example using its respective assembly portion. The spring ring 91 can for example be clipped onto a fluid line 92.

The spring rings 90 and 9 colored ring 72 are colored marking parts 100.

Striation 94 avoids slipping of the rings 90 and 91 on the respective fluid port part or the respective fluid line. On one peripheral longitudinal side a lead-in slot 94 is provided, using which the respective spring ring 90 and 91 may be clipped onto a fluid port part 80 or a fluid line 92.

The release ring 65 can f. i. be provided with a colored surface coating for colored encoding or may be colored right through its material. It is possible as well to arrange a detachable color marking part, as for example a ring 120, on the release ring 65. The ring 120 is f. i. provided with a colored surface coating or is colored right the way through its material. The ring 120 preferably consists of a flexible plastic. The ring 120 can also be slipped onto the release ring 65 from the front. The ring has f. i. an annular groove 121, which in the mounted state thereof has an annular projection 122 of the release ring 65 fitting into it.

Furthermore a mechanical marking or encoding is also possible by having a suitable configuration of the release rings. Thus for example release rings 55, 65 and 75 have a round outline, whereas a release ring 85 of the fluid port part 80 has a polygonal outline such as a hexagonal one.

By feeling the differently formed release rings 55 or 85 or the release rings 34 projecting different distances s from the fluid port body 37 it is possible for the proper fluid port to be felt even in dark or obscure areas.

The release rings 36, 55, 65, 75 and 85 are release actuating parts 101.

As a light marking, and in particular a colored light encoding or colored encoding, it is also possible to arrange for example a white or colored LED, such as on one of the fluid ports 19*a*, 21*a* and/or 20*a* and 22*a*.

It is possible as well to utilize a colored light or luminous encoding or a colored encoding in the form of reflecting materials.

The invention claimed is:

1. A fluid power arrangement comprising a valve means and a fluid power implement, which is connected or is able to be connected with the valve means by way of a first fluid line and at least one second fluid line for fluid actuation through the valve means, the valve means and the implement constituting spatially separate assembly units, the valve means having a first valve fluid port for the first fluid line and at least one second valve fluid port for the at least one second fluid line and the implement having a first implement fluid port for the first fluid line and at least one second implement fluid port for the at least one second fluid line, wherein, on the first valve fluid port and the first implement fluid port on the one hand and on the at least one second valve fluid port and the at least one second implement fluid port on the other hand, mutually different port encodings are provided so that a coordination of the first valve fluid port with the first implement fluid port and of the at least one second valve fluid port with the at least one second implement fluid port is apparent on the basis of the respective mutually corresponding port encodings, and wherein fluid line encodings are provided on the first or on the at least one second fluid line at least at the their terminal portion associated with the implement fluid ports or the valve fluid ports, the fluid line encodings corresponding to the port encodings, and wherein the port encodings and/or the fluid line encodings include colored encodings, and wherein at least one colored encoding is provided on a colored marking ring, such ring being arranged or being able to be arranged on the respective fluid port or the respective fluid line, and wherein the colored marking ring is adapted to be detachably secured to the respective fluid port or the respective fluid line, and wherein the port encodings and/or the fluid line encodings include mechanical markings, and wherein the mechanical markings are haptically distinct so that they may be sensed by the user.

2. The fluid power arrangement as set forth in claim 1, wherein the mutually corresponding port encodings are identical.

3. The fluid power arrangement as set forth in claim 1, wherein the mutually corresponding fluid line encodings are identical.

4. The fluid power arrangement as set forth in claim 1, wherein the colored marking ring is detachably secured on a release actuating part of a fluid port.

5. The fluid power arrangement as set forth in claim 1, wherein the colored marking ring is detachably secured on a housing portion, containing the respective fluid port.

6. The fluid power arrangement as set forth in claim 1, wherein the colored marking ring is detachably secured on or adjacent to a screw portion of a fluid port body, which is mounted or is able to be mounted on the valve means or on the implement.

7. The fluid power arrangement as set forth in claim 1, further comprising a regulation system for the control of the valve means.

8. The fluid power arrangement as set forth in claim 1, wherein the valve means is a component of a valve cluster.

9. A fluid power arrangement comprising a valve means and a fluid power implement, which is connected or is able to be connected with the valve means by way of a first fluid line and at least one second fluid line for fluid actuation through the valve means, the valve means and the implement constituting spatially separate assembly units, the valve means having a first valve fluid port for the first fluid line and at least one second valve fluid port for the at least one second fluid line and the implement having a first implement fluid port for the first fluid line and at least one second implement fluid port for the at least one second fluid line, wherein, on the first valve fluid port and the first implement fluid port on the one hand and on the at least one second valve fluid port and the at least one second implement fluid port on the other hand, mutually different port encodings are provided so that a coordination of the first valve fluid port with the first implement fluid port and of the at least one second valve fluid port with the at least one second implement fluid port is apparent on the basis of the respective mutually corresponding port encodings, and wherein fluid line encodings are provided on the first or on the at least one second fluid line at least at the their terminal portion associated with the implement fluid ports or the valve fluid ports, the fluid line encodings corresponding to the port encodings, and wherein the port encodings and/or the fluid line encodings include colored encodings, and wherein at least one colored encoding is provided on a colored marking ring, such ring being arranged or being able to be arranged on the respective fluid port or the respective fluid line, and wherein the colored marking ring is adapted to be detachably secured to the respective fluid port or the respective fluid line, and wherein the port encodings and/or the fluid line encodings include mechanical markings, and wherein the mechanical marking comprises a striation and/or a particular geometry of an outline of the respective fluid port or a respective fluid line.

10. A fluid power arrangement comprising a valve means and a fluid power implement, which is connected or is able to be connected with the valve means by way of a first fluid line and at least one second fluid line for fluid actuation through the valve means, the valve means and the implement constituting spatially separate assembly units, the valve means having a first valve fluid port for the first fluid line and at least one second valve fluid port for the at least one second fluid line and the implement having a first implement fluid port for the first fluid line and at least one second implement fluid port for the at least one second fluid line, wherein, on the first valve fluid port and the first implement fluid port on the one hand and on the at least one second valve fluid port and the at least one second implement fluid port on the other hand, mutually different port encodings are provided so that a coordination of the first valve fluid port with the first implement fluid port and of the at least one second valve fluid port with the at least one second implement fluid port is apparent on the basis of the respective mutually corresponding port encodings, and wherein fluid line encodings are provided on the first or on the at least one second fluid line at least at the their terminal portion associated with the implement fluid ports or the valve fluid ports, the fluid line encodings corresponding to the port encodings, and wherein the port encodings and/or the fluid line encodings include colored encodings, and wherein at least one colored encoding is provided on a colored marking ring, such ring being arranged or being able to be arranged on the respective fluid port or the respective fluid line, and wherein the colored marking ring is adapted to be detachably secured to the respective fluid port or the respective fluid line, and wherein the port encodings and/or the fluid line encoding include graphic markings.

11. A fluid power arrangement comprising a valve means and a fluid power implement, which is connected or is able to be connected with the valve means by way of a first fluid line and at least one second fluid line for fluid actuation through the valve means, the valve means and the implement constituting spatially separate assembly units, the valve means having a first valve fluid port for the first fluid line and at least one second valve fluid port for the at least one second fluid line and the implement having a first implement fluid port for the first fluid line and at least one second implement fluid port for the at least one second fluid line, wherein, on the first valve fluid port and the first implement fluid port on the one hand and on the at least one second valve fluid port and the at least one second implement fluid port on the other hand, mutually different port encodings are provided so that a coordination of the first valve fluid port with the first implement fluid port and of the at least one second valve fluid port with the at least one second implement fluid port is apparent on the basis of the respective mutually corresponding port encodings, and wherein fluid line encodings are provided on the first or on the at least one second fluid line at least at the their terminal portion associated with the implement fluid ports or the valve fluid ports, the fluid line encodings corresponding to the port encodings, and wherein the port encodings and/or the fluid line encodings include colored encodings, and wherein at least one colored encoding is provided on a colored marking ring, such ring being arranged or being able to be arranged on the respective fluid port or the respective fluid line, and wherein the colored marking ring is adapted to be detachably secured to the respective fluid port or the respective fluid line, and wherein the valve means is a pneumatic valve means and the fluid power implement is a pneumatic or an electropneumatic drive.

12. The fluid power arrangement as set forth in claim 11, wherein the mutually corresponding port encodings are identical.

13. The fluid power arrangement as set forth in claim 11, wherein the mutually corresponding fluid line encodings are identical.

14. The fluid power arrangement as set forth in claim 11, wherein the colored marking ring is detachably secured on a release actuating part of a fluid port.

15. The fluid power arrangement as set forth in claim 11, wherein the colored marking ring is detachably secured on a housing portion, containing the respective fluid port.

16. The fluid power arrangement as set forth in claim 11, wherein the colored marking ring is detachably secured on or adjacent to a screw portion of a fluid port body, which is mounted or is able to be mounted on the valve means or on the implement.

17. The fluid power arrangement as set forth in claim 11, further comprising a regulation system for the control of the valve means.

18. The fluid power arrangement as set forth in claim 11, wherein the valve means is a component of a valve cluster.

19. The fluid power arrangement as set forth in claim 11, wherein the port encodings and/or the fluid line encodings include mechanical markings.

20. A fluid power arrangement comprising:

a valve means having a first fluid port part and a second fluid port part, each of said first and second fluid port parts including an assembly portion, a release actuating portion and a colored marking ring, said assembly portion having screw threads for threaded connection with a valve fluid port of said valve means, said release actuating portion having a release ring axially movable into a release position for releasing a fluid line connected thereto, and said colored marking ring being detachably secured to one of said assembly portion or said release ring of said fluid port part;

a fluid power implement spatially separated from said valve means, said fluid power implement having a first fluid port part and a second fluid port part, each of said first and second fluid port parts including an assembly portion, a release actuating portion and a colored marking ring, said assembly portion having screw threads for threaded connection with a valve fluid port of said fluid power implement, said release actuating portion having a release ring axially movable into a release position for releasing a fluid line connected thereto and said colored marking ring being detachably secured to one of said assembly portion or said release ring of said fluid port part of said fluid power implement;

a first fluid line fluidly connecting said first fluid port part of said valve means and said first fluid port part of said fluid power implement; and a second fluid line fluidly connecting said second fluid port part of said valve means and second fluid port part of said fluid power implement, wherein said colored marking rings of said first fluid port part of said valve means and said first fluid port part of said fluid power implement have a matching color, and wherein said colored marking rings of said second fluid port part of said valve means and said second fluid port part of said fluid power implement have a matching color, and wherein the color of said colored marking rings of said first fluid port part of said valve means and said first fluid port part of said fluid power implement is different than the color of said colored marking rings of said second fluid port part of said valve means and said second fluid port part of said fluid power implement so that a coordination of said first valve fluid port part with said first implement fluid port part and of said second valve fluid port part with said second implement fluid port part is apparent.

* * * * *